United States Patent [19]

Godley

[11] 3,938,922

[45] Feb. 17, 1976

[54] MEANS FOR FORMING A PRESTRESSED SLAB INCLUDING COLLAPSIBLE BULKHEADS

[75] Inventor: Fred Darroll Godley, Charlotte, N.C.

[73] Assignee: Modular Wall Systems, Inc., Charlotte, N.C.

[22] Filed: Mar. 28, 1974

[21] Appl. No.: 455,749

Related U.S. Application Data

[62] Division of Ser. No. 186,837, Oct. 6, 1971.

[52] U.S. Cl. ..... 425/111; 249/50; 249/78; 249/131

[51] Int. Cl.[2] ..... B28B 23/04

[58] Field of Search ..... 249/50, 78, 129–131, 249/98, 99, 9, 157, 120; 425/111, 144, 443; 264/228–229, 334

[56] References Cited

UNITED STATES PATENTS

| | | | |
|---|---|---|---|
| 1,988,900 | 1/1935 | Heltzel | 249/9 |
| 2,495,100 | 1/1950 | Henderson | 425/111 |
| 2,942,321 | 6/1960 | Pinter et al. | 264/228 |
| 2,966,717 | 1/1961 | Fuller et al. | 249/50 |
| 3,063,122 | 11/1962 | Katz | 249/157 |
| 3,070,867 | 1/1963 | Belle | 264/228 |
| 3,092,886 | 6/1963 | Dykeman et al. | 249/50 |
| 3,204,316 | 9/1965 | Jackson | 264/334 |
| 3,595,516 | 7/1971 | Rice | 249/50 |
| 3,659,077 | 4/1972 | Olson | 249/78 |

*Primary Examiner*—Robert D. Baldwin
*Assistant Examiner*—John McQuade
*Attorney, Agent, or Firm*—Parrott, Bell, Seltzer, Park & Gibson

[57] ABSTRACT

Cast panels for building assembly and erection are formed and cured through the use of an apparatus which particularly facilitates high rates of production of such panels and thereby facilitates more economical building construction practices. Fluid materials being cast into panels are received within forms which comprise a cured concrete bed defining a horizontal planar surface maintained at an elevated temperature. Following curing of the fluid materials cast into the forms, stripping of the panels from the form is facilitated by vertically movable side forming members and by bulkheads separating the cured materials into predetermined panel lengths.

5 Claims, 6 Drawing Figures

MEANS FOR FORMING A PRESTRESSED SLAB INCLUDING COLLAPSIBLE BULKHEADS

This application is a division of copending application Ser. No. 186,837 filed Oct. 6, 1971.

The development of construction practices which satisfactorily employ precast panels of materials such as concrete has included the development of arrangements and methods for forming and curing such panels. Typically, the arrangements used heretofore provide a forming means for receiving fluid materials, such as concrete mixes of Portland cement or the like, aggregate and water being cast into panels. Concrete delivered as a fluid material and cast into a form to produce panels typically requires some interval of time before curing to such a strength that the panel may be handled as a monolithic structure. One practice heretofore followed was to permit the poured concrete to remain in the form until it had cured to the extent required to provide the necessary structural strength. This practice was quickly recognized as requiring an excessively long time in the form and thereby severly limiting the production rate of precast panels.

In efforts to decrease the time required to cure a panel, steam and the like has been introduced into pipes to heat fluid materials being cast into panels. However, the resultant thermal shock on admission of the steam has required that the forming means employed be constructed of metal, usually steel. This reliance upon metallic forming means heated by steam introduces several difficulties including the need to maintain the metal forming means in a suitably clean and rust free condition, the relatively high capital cost of such an arrangement, and a lack of flexibility in producing panels having varying characteristics.

It is an object of the present invention to form and cure panels cast of a fluid material such as concrete mix and the like in accordance with a method and through the use of an apparatus which overcome the difficulties and deficiencies of prior practices. In accomplishing this object of the present invention, reliance is placed upon use of a forming means defining a lengthy elongate bed which is maintained at an elevated temperature and which may be subdivided lengthwise to produce panels of varying dimensions. Further, the forming means of the present invention comprises a cured concrete bed defining a horizontal planar surface for supporting fluid material being cast into panels, which cured concrete bed may be placed into operation at a capital expenditure markedly below that required for prior metallic forming means. In using the cured concrete bed, the present invention obviates the possibility of thermal shock damage to the cured concrete bed by maintaining the bed at an elevated temperature.

Yet a further object of this invention is to facilitate the release of a cured precast panel from a forming means. In accomplishing this object of the present invention, reliance is placed upon side forming members arranged to move vertically for a short distance with the panel being stripped from the forming means and thereafter to return to the normal operative position by falling away from the panel being stripped. In accordance with this invention, the side forming means return to the operative position following stripping of the panel from the forming means and thereby facilitate more rapid recycling of the forming means for production of additional panels.

Another object of the present invention is to facilitate the production of panels of any desired lengths through the subdivision of an elongate forming means with bulkhead members. By the positioning of bulkhead members at desired spaced locations, panels of any desired length may be formed in the elongate forming means. Further, the bulkheads dividing adjacent panels, in accordance with this invention, freely release such panels to be stripped from the forming bed and thereby facilitate more rapid recycling of the forming means and greater rates of production for cast panels.

Some of the objects and advantages of the invention having been stated, others will appear as the description proceeds, when taken in connection with the accompanying drawings, in which FIG. 1 is a perspective view of an apparatus in accordance with this invention, partly broken away and partly schematic;

Figure 1:
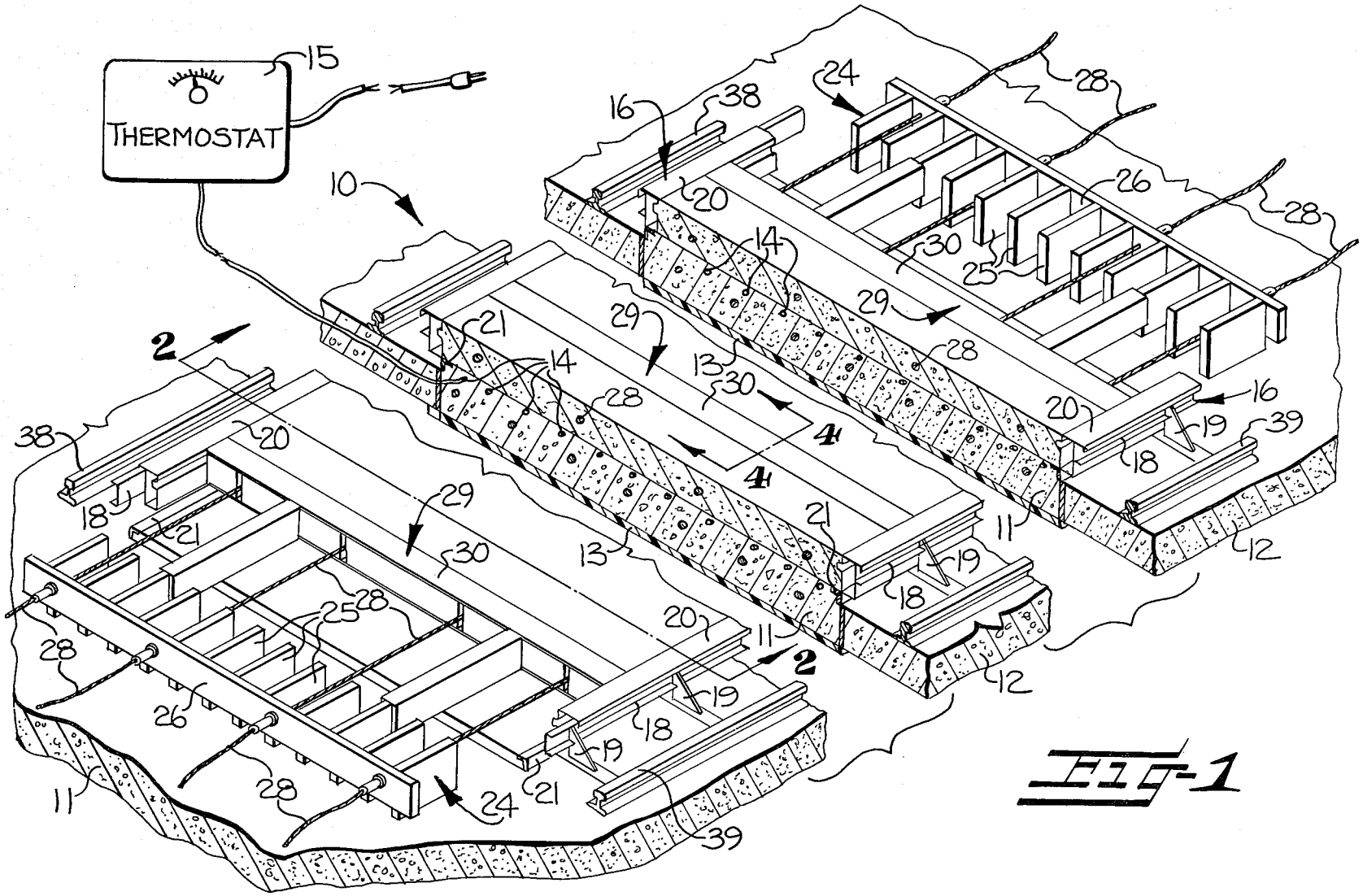

In the detailed description which follows, reference will be had to the illustrative embodiment of this invention shown in the accompanying drawings. While the accompanying drawings and the detailed description are set forth in order that this invention may be readily and fully understood by persons skilled in the construction trades and in the forming and curing of cast concrete panels, it is contemplated that a person skilled in such arts may apply the present disclosure to apparatus and methods not disclosed in detail herein. For this reason, the accompanying drawings and the following detailed description are to be taken as illustrative only and not as limiting upon the scope of this invention.

The present invention contemplates the use of forming means generally indicated at 10 for receiving fluid materials such as concrete mix being cast into building panels to be used in the erection and assembly of building structures. Panels of this general class are known to persons engaged in the construction trades and have been disclosed in various previously issued patents, to which reference may be had for other and further disclosures. In accordance with an important feature of the present invention, the forming means 10 comprises a cured concrete bed 11 defining a horizontal planar surface for supporting concrete being cast into panels as disclosed more fully hereinafter. Preferably, the cured concrete bed 11 is of substantial length, as on the order of 150 to 300 feet long, and is of a width predetermined to produce a desired modular panel height, such as four feet to eight feet. For purposes of accommodating manufacture of panels using the cured concrete bed 11, a conventional cast concrete building floor 12 may surround the bed 11 if desired, with it being preferred that a suitable thermal insualtion barrier 13 be interposed between the surrounding factory floor 12 and the cured concrete bed 11.

In accordance with an important feature of this invention, the cured concrete bed 11 has positioned therewithin electrical resistance heating elements 14, cast in situ during initial formation of the cured concrete bed 11. By means of an appropriate electrical or electronic thermostatic control 15 and connection with a source of electrical current, such as conventional line power, the electrical resistance heating elements 14 embedded in the cured concrete bed 11 may be maintained at an elevated temperature sensed within the bed by the control 15, cooled slowly to an ambient temperature, or heated slowly to the desired elevated temperature. The heating effect of the electrical resistance elements 14 is to be distinguished from the heating effects heretofore obtained by means of steam flowing through piping systems, in that the slower rate of change obtained by the electrical heating elements 14 avoids the thermal shock which occurs where steam is employed as a source of heat for curing of cast concrete.

Figure 2:
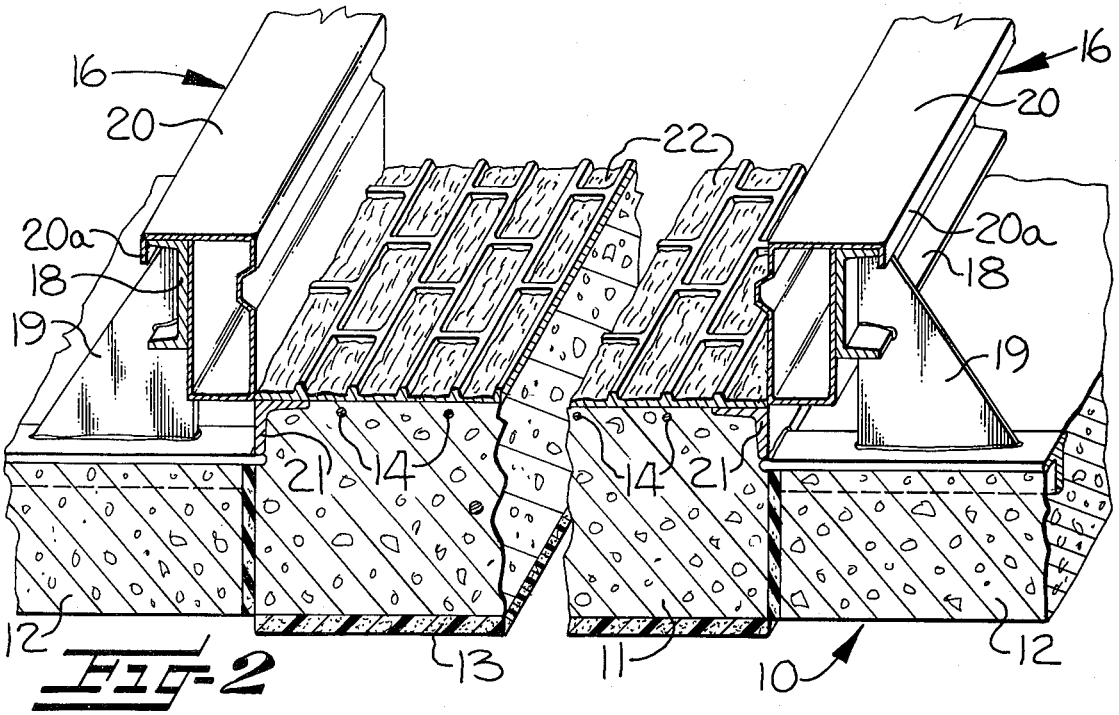
FIG. 2 is an enlarged perspective view of a portion of the apparatus in accordance with this invention, taken generally along the line 2—2 in FIG. 1, showing the forming means as prepared for receiving fluid material being cast into panels.

Extending longitudinally of the cured concrete bed 11 and on either side thereof are side form means generally indicated at 16. Each of the side form means 16 includes an elongate stationary support member 18 mounted from the work floor 12 to extend adjacent but in spaced relation to the cured concrete bed 11. In the form illustrated, the elongate members 18 are of channel cross-section and are supported by spaced triangular upright members 19. Engaging with the channel members 18 are slip side forms 20 of generally box-like cross-sectional configuration. Each side slip form 20 has a configured side to form a tongue or groove in a panel cast thereagainst and an elongate projecting lip portion 20a extending from the upper surface thereof to overlie the upper extremity of a cooperating channel member 18 (FIG. 2). By means of the engagement of the side slip form 20 with the channel member 18, the side forms are normally maintained in spaced relation one from another extending longitudinally of the cured concrete bed 11.

It is to be noted that the dimensions of the side slip forms 20, the cured concrete forming bed 11 and the factory floor 12 are such that the horizontal planar surface defined by the cured concrete bed 11 is elevated a short distance above the adjacent factory floor 12. Further, the cured concrete bed 11 incorporates side edge reinforcing members 21, such as elongate angle iron members, which extend along the outer upper longitudinal edges thereof to assist in guarding against impact damage to the bed 11. The side slip forms 20 (when in the position of FIG. 2) terminate closely adjacent the angle members 21 so as to provide a seal therewith against the flow of fluid material being cast and thereby prevent the concrete mix from escaping from the forming means.

It is contemplated that texture may be imparted to a panel being cast in the forming means of this invention by the inclusion of a form liner. By way of illustration only, a form liner 22 is shown in FIG. 2 which would impart to a panel cast thereagainst a decorative appearance simulating hand laid masonry such as brick. While the form liner 22 or other similar structures may be preferred for some applications of the apparatus of this invention, it is contemplated that such a form liner may be present or absent as may be desired or considered necessary.

Adjacent each terminal end of the elongate forming means which comprises the cured concrete bed 11 and the side form means 16 are positioned reinforcement securing bulkhead arrangements generally indicated at 24. In each instance, the reinforcement securing arrangements comprise a plurality of generally upright abutment members 25 which preferably extend downwardly a substantial distance into the factory floor 12 and are thereby securely anchored against tension forces directed longitudinally of the cured concrete bed 11. By means of transverse force distributing member 26, a plurality of cables 28 or the like are accommodated in extending longitudinally of the cured concrete bed 11. In accordance with conventional prestressed concrete construction practices, such cables are disposed in the forming means 10 prior to the casting of concrete mix thereinto and are placed under longitudinal tension by means of hydraulic jacks or the like before panel casting proceeds.

Figure 4:
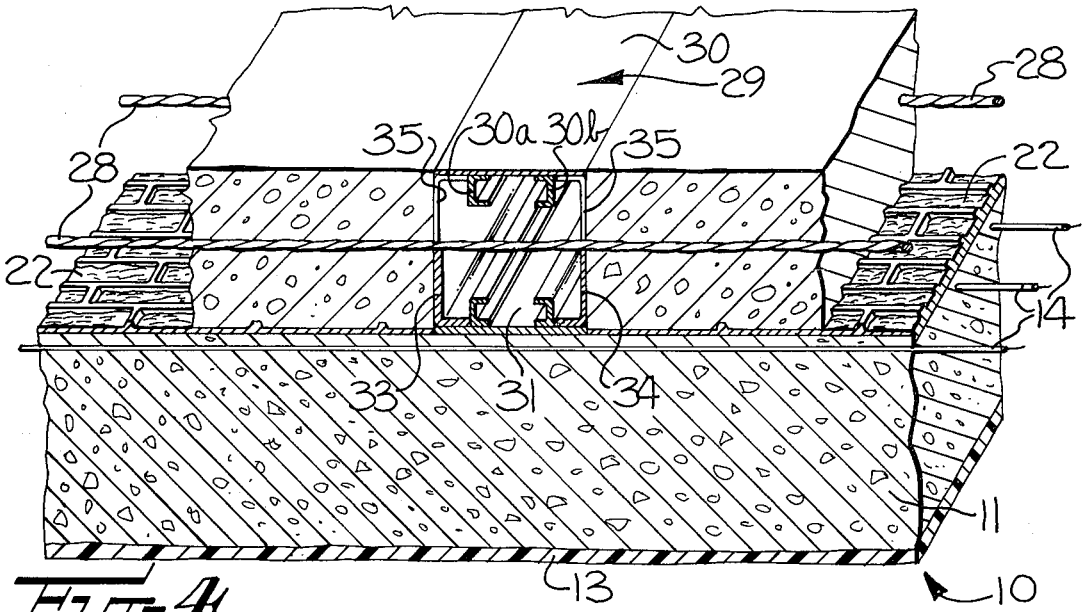
FIG. 4 is an enlarged perspective view, partially broken away and partially in section, taken generally along the line 4—4 in FIG. 1.
Figure 5:
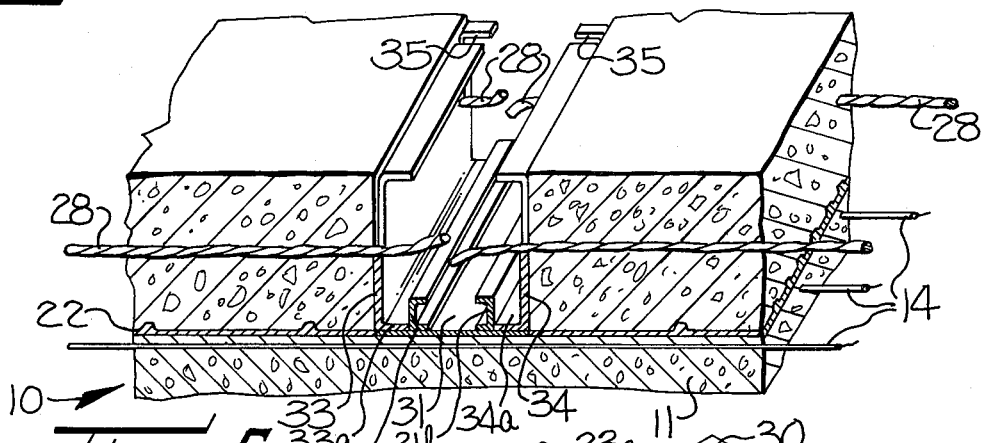
FIG. 5 is a view similar to FIG. 4, illustrating a further step in the method of this invention for forming and curing panels.
Figure 6:
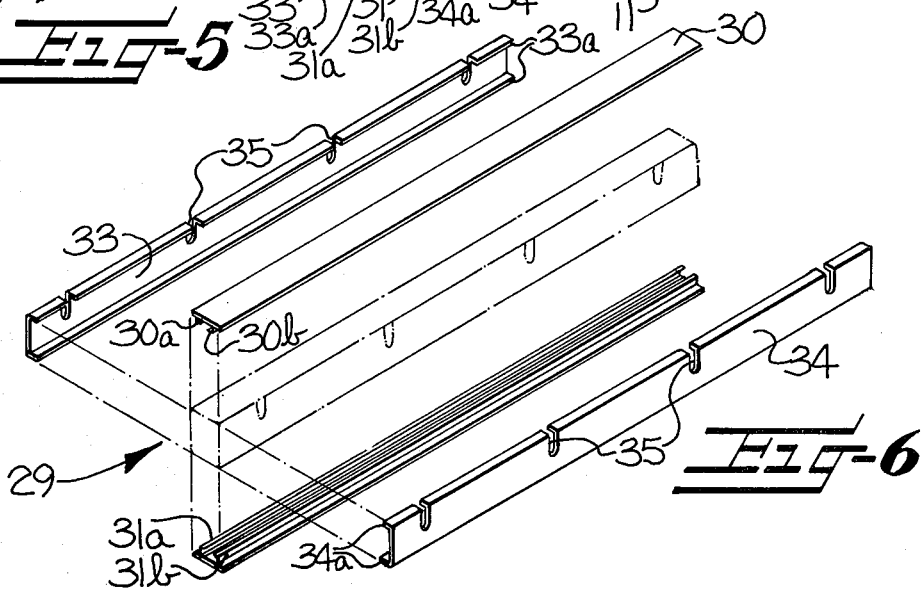
FIG. 6 is an exploded perspective view, in reduced scale, of a bulkhead illustrated in FIGS. 4 and 5.

Prior to pouring concrete mix or the like into the bed 10 to form cast panels, the substantial length of the bed is subdivided longitudinally by disposition therein of bulkhead means as generally indicated at 29. Each bulkhead means 29 includes upper and lower plate members 30, 31 (FIGS. 4–6) and side plate members 33, 34. Each of the side plate members has a plurality of upwardly opening notches 35 therein, for accommodation of tensioned reinforcing cables 28 (FIGS. 4 and 5). In preparation for casting of panels into the apparatus 10, lower plate members 31 are positioned along the cured concrete bed 11 at predetermined spaced intervals desired for the length of panels to be formed, such as 10 or 20 feet. Thereafter, the side plate members 33, 34 are positioned on the lower plate members 31 in generally upright positions and upper plate members 30 are assembled with the side members to form a closed box for each bulkhead means 29. By such formation of a closed box, introduction of concrete to be cured into the space within the bulkhead means 29 is precluded.

Following forming and curing of panels, the upper plate members 30 are removed to permit access to the cables 28 which are severed to free adjacent cast panels (FIG. 5).

Figure 3:
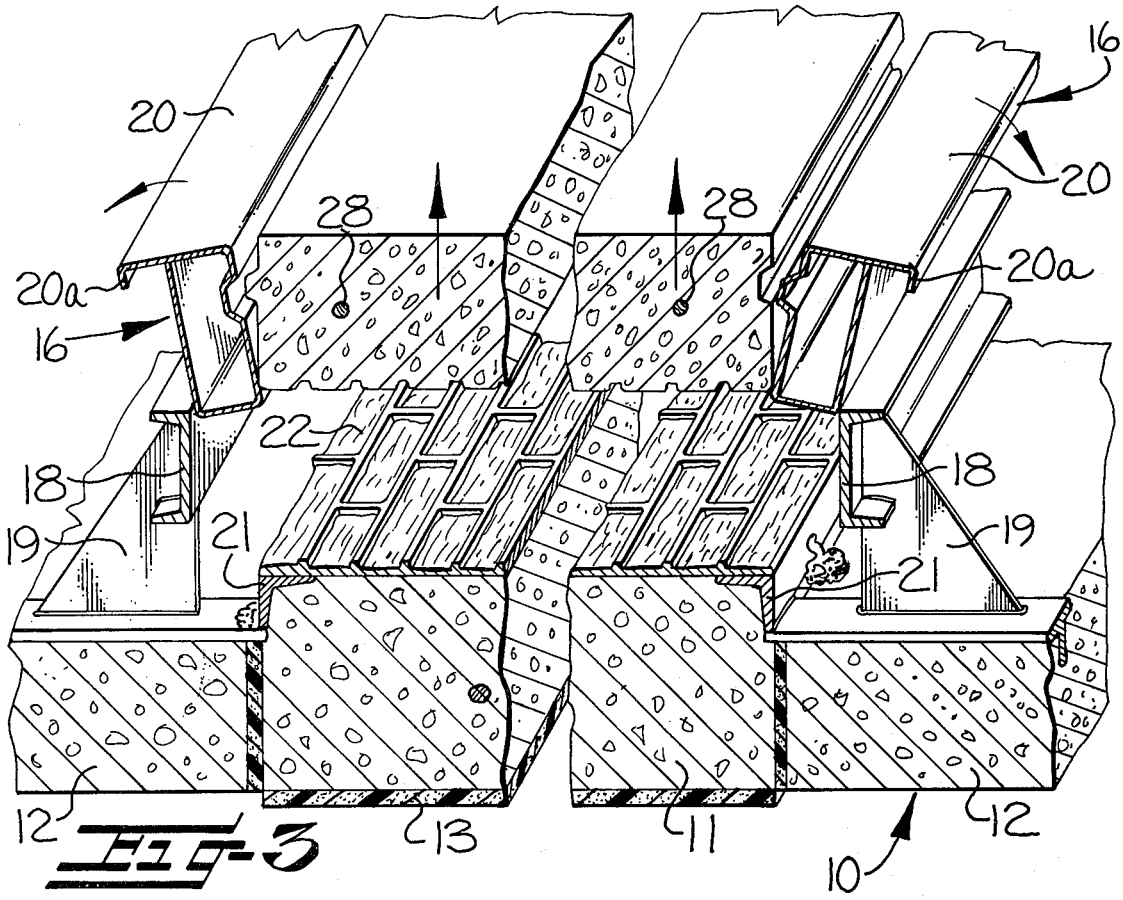
FIG. 3 is a view similar to FIG. 2, illustrating the stripping of a cast and cured panel from the apparatus of this invention.

On stripping of a panel from the apparatus 10 (FIG. 3), the side form means 16 and the bulkhead means 29 cooperate to facilitate quick return of the apparatus 10 to the condition required for the next subsequent cycle of casting. In particular, the side slip forms 20 rise with the panel being stripped from the bed 11 to such an extent as to free tongue and groove projections and recesses formed in the upper and lower side edges of the panels. The side slip forms 20 then move outwardly away from the panel and fall back down to the operative position. Similarly, the upper extremities of the side plate members 33, 34 of the bulkhead means 29 move away from the ends of the panel, toppling backward to a more nearly horizontal position due to engagement of lower lips 33*a*, 34*a* thereof with channel members 31*a*, 31*b* of the lower plate member 31. It is to be noted that channel members are also provided on the upper plate member 30 to assure proper spacing of the side plate members 33, 34 during casting of a panel.

In practicing the method disclosed herein electrical current is delivered through the control 15 to the resistance heating elements 14 embedded in the cured concrete bed 11, in order to slowly heat the bed to a desired operating temperature such as approximately 180°F. When slowly heated to such an operating temperature, thermal shock to the cured concrete of the bed 11 is avoided while the temperature of the bed is elevated to such a degree as to contribute to accelerated curing of concrete poured thereonto. Reinforcing cables 28 are positioned to extend for the length of the forming bed and are placed under proper tension. Bulkhead means 29 are positioned at appropriate spaced intervals to subdivide the length of the elongate bed into individual panel lengths.

With the bed prepared for casting, suitable concrete delivery equipment (not to be disclosed herein in detail) is traversed from one end of the bed to the other, as along rails 38, 39 extending adjacent the cured concrete bed 11. Fluid material such as a concrete mix is deposited into the forming bed, to encase the reinforcing cables 28, to assume the shape imparted by any form liner 22, the side slip forms 20 and the bulkhead means 29. Due to the elevated temperature of the cured concrete bed 11, curing of the concrete poured into the bed proceeds more rapidly than would be the case if ambient temperature alone was relied upon. Thereafter, upon the concrete becoming cured to such a degree as to have the necessary strength, the cables 28 are cut and individual panels are lifted upwardly from the forming apparatus 10 and transported to a construction sit or to a storage yard.

In the drawings and specification, there has been set forth a preferred embodiment of the invention, and although specific terms are employed, they are used in a generic and descriptive sense only and not for purposes of limitation.

I claim:

1. An apparatus for forming and curing cast panels comprising:

an elongate bed defining a horizontal planar surface for supporting material being cast, side form means for facilitating stripping of a cast panel and including a pair of stationary support means extending parallel and in spaced relation to said bed and a pair of slip form means engaging corresponding ones of said support means for movement vertically relative to said bed and said support means between a forming position wherein material cast between said slip form means is retained therebetween and an elevated release position wherein a cast panel may be stripped from said apparatus, and a plurality of bulkhead means disposed transversely between said side frame means for dividing material cast into said apparatus into a plurality of discrete panel lengths, each said bulkhead means being defined by a plurality of discrete plate members including a lower plate member, a pair of side plate members supported on said lower plate member and an upper plate member normally overlying said pair of side plate members, said plate members having stop means for normally arranging said plate members to define a hollow box structure, said stop means including inwardly directed lip portions of said side plate members and members extending vertically from said upper and lower plate members for engaging said lip portions and each of said side plate members being pivotally movable relative to the corresponding lower plate member upon removal of the corresponding upper plate member between an upright forming position whrein material being cast is retained and a tilted release position wherein a cast panel may be stripped from said apparatus.

2. Apparatus according to claim 1 wherein said elongate bed comprises a body of cured concrete and further wherein the apparatus comprises means for accelerating curing of material supported on said elongate bed and including electrical heating means embedded in said body of cured concrete for raising the same to an elevated temperature, whereby said cured concrete body is protected against damage otherwise possibly occuring due to excessively high rates of temperature change.

3. Apparatus according to claim 1 further comprising reinforcement securing bulkhead means disposed in alignment with and at the opposite ends of said bed for receiving terminal end portions of tensioned reinforcing members disposed in said apparatus in preparation for panel casting.

4. A combination according to claim 1 wherein said slip form means have opposing vertical faces configured for shaping panel edges into matingly engaging surfaces and further wherein movement of said slip form means to said elevated release position accommodates extraction of said panel edges from said slip form means.

5. A combination according to claim 1 wherein said slip form means have horizontal projecting portions overlying said corresponding ones of said support means and coupling therewith for facilitating return of said slip form means to said forming position following stripping of a cast panel from said apparatus.

* * * * *